US010991487B2

(12) United States Patent
Sagawa et al.

(10) Patent No.: US 10,991,487 B2
(45) Date of Patent: Apr. 27, 2021

(54) CABLE AND PRODUCING METHOD THEREFOR

(71) Applicant: Hitachi Metals, Ltd., Tokyo (JP)

(72) Inventors: Hideyuki Sagawa, Tokyo (JP); Takahiro Sugiyama, Tokyo (JP); Kazufumi Suenaga, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/740,061

(22) Filed: Jan. 10, 2020

(65) Prior Publication Data

US 2020/0234855 A1 Jul. 23, 2020

(30) Foreign Application Priority Data

Jan. 22, 2019 (JP) ..... JP2019-008637

(51) Int. Cl.

| | |
|---|---|
| ***H01B 11/06*** | (2006.01) |
| ***H01B 13/22*** | (2006.01) |
| ***H01B 13/16*** | (2006.01) |
| ***H01B 7/18*** | (2006.01) |
| ***H01B 7/02*** | (2006.01) |
| *H01B 13/14* | (2006.01) |

(52) U.S. Cl.

CPC ..... *H01B 13/228* (2013.01); *H01B 7/0216* (2013.01); *H01B 7/1805* (2013.01); *H01B 13/165* (2013.01); *H01B 13/145* (2013.01)

(58) Field of Classification Search

CPC ..... H01B 11/04; H01B 11/06

See application file for complete search history.

(56) References Cited

U.S. PATENT DOCUMENTS

| | | | | |
|---|---|---|---|---|
| 9,832,914 | B2 * | 11/2017 | Hyun | H05K 9/0024 |
| 2009/0229850 | A1 * | 9/2009 | Cases | H01B 11/20 174/102 R |
| 2011/0083877 | A1 * | 4/2011 | Sugiyama | H01P 11/001 174/115 |
| 2019/0013559 | A1 | 1/2019 | Suenaga et al. | |

FOREIGN PATENT DOCUMENTS

| | | | |
|---|---|---|---|
| JP | 6245402 | B1 | 12/2017 |

* cited by examiner

*Primary Examiner* — Chau N Nguyen

(74) *Attorney, Agent, or Firm* — McGinn I.P. Law Group, PLLC.

(57) ABSTRACT

A cable is composed of a linear shape conductor, a first electrical insulating member coating a periphery of the conductor, a shield made of a plating layer coating a surface of the first electrical insulating member, a second electrical insulating member coating a surface of the shield, and an exposed shield portion provided in at least one end portion of the cable with the second electrical insulating member being removed therefrom and the shield being exposed therein during termination. An adhesion strength between the shield and the second electrical insulating member in the exposed shield portion is lower than an adhesion strength between the shield and the second electrical insulating member in an other part of the surface of the shield.

12 Claims, 4 Drawing Sheets

CABLE AND PRODUCING METHOD THEREFOR

CROSS-REFERENCE TO RELATED APPLICATIONS

The present invention is based on Japanese Patent Application No. 2019-008637 filed on Jan. 22, 2019, the entire contents of which are incorporated herein by reference.

BACKGROUND OF THE INVENTION

1. Field of the Invention

The present invention relates to a cable and a producing method therefor.

2. Description of the Related Art

Conventionally, there is known a cable with a shield formed by a plating treatment (for example, see Japanese Patent No. 6245402). Japanese Patent No. 6245402 discloses a cable configured to include one pair of signal wires, an electrical insulating member layer coating a periphery of the one pair of signal wires, a plating layer acting as a shield coating the electrical insulating member layer, and an outer electrical insulating layer coating a periphery of the plating layer.

Conventionally, generally, a method of forming a shield by wrapping a tape composed of a copper foil and an electrical insulating film laminated together is used. This method allows the copper foil to act as the shield and the electrical insulating film to act as the electrical insulating member coating the shield, therefore resulting in concurrent formation of the shield and the electrical insulating member. However, the method of forming the shield by wrapping that tape is low in work efficiency and tends to cause an air gap formation between that tape and the electrical insulating member to be wrapped with that tape.

When the shield is formed by the aforementioned plating treatment, the above problem of the shield forming method by the tape wrapping can be overcome, but it is necessary to form the outer electrical insulating member to coat the periphery of the plating layer in a step separate from the shield forming step. Japanese Patent No. 6245402 discloses, as methods for forming the outer electrical insulating layer, a method using an electrical insulating tape or a laminate tape, and a method by spray coating an electrical insulating material.

[Patent Document 1] Japanese Patent No. 6245402

SUMMARY OF THE INVENTION

However, when coating the shield made of the plating layer with the electrical insulating material, it is necessary to make the strength of the adhesion between the shield and the electrical insulating material high, but on the other hand, when making the strength of the adhesion between the shield and the electrical insulating material high, it is difficult to remove the electrical insulating material and expose the shield during the termination of the cable.

Accordingly, it is an object of the present invention to provide a cable, which is structured to be high in the strength of the adhesion between a shield and an electrical insulating member overlying a periphery of that shield, and it is another object of the present invention to provide a method for producing the same cable.

For the purpose of solving the above problems, the present invention provides a cable, comprising: a linear shape conductor; a first electrical insulating member coating a periphery of the conductor; a shield comprising a plating layer coating a surface of the first electrical insulating member; a second electrical insulating member coating a surface of the shield; and an exposed shield portion provided in at least one end portion of the cable with the second electrical insulating member being removed therefrom and the shield being exposed therein during termination, wherein an adhesion strength between the shield and the second electrical insulating member in the exposed shield portion is lower than an adhesion strength between the shield and the second electrical insulating member in an other part of the surface of the shield.

Points of the Invention

According to the present invention, it is possible to provide the cable structured to be high in the strength of the adhesion between the shield and the second electrical insulating member overlying the periphery of that shield, and easy to terminate, and it is possible to provide the method for producing the same cable.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiments (Structure of a Linear Shape Member)

Figure 1:
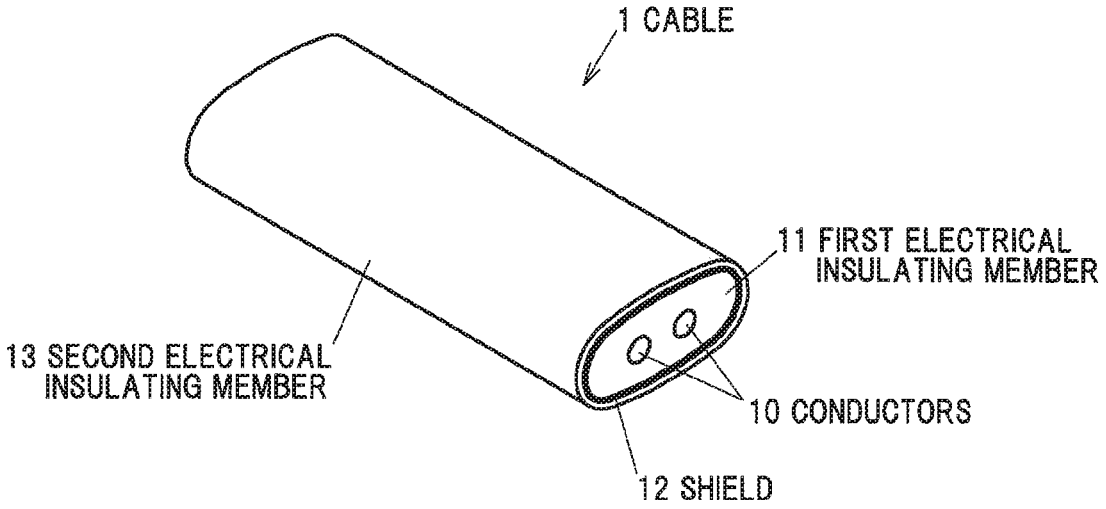
FIG. 1 is a perspective view of a cable according to a first embodiment.

FIG. 1 is a perspective view showing a cable 1 to be used as a linear shape member according to a first embodiment. The cable 1 is configured to include two conductors 10, a linear shape first electrical insulating member 11, which is provided over a periphery of the two conductors 10, a shield 12, which is made of a plating layer and is provided to directly coat a surface (an outer peripheral surface) of the first electrical insulating member 11, and a second electrical insulating member 13, which is provided to directly coat a surface (an outer peripheral surface) of the shield 12. The cable 1 is, e.g., 0.1 to 5.0 μm in diameter.

The linear shape conductors 10 constitute a core of the cable 1 and are each made of a conductor such as a copper or the like. Further, the conductors 10 may be configured as a stranded wire, which is formed by laying a plurality of conducting wires together in order to ensure a bending property. The number of the conductors 10 included in the cable 1 is not particularly limited but is appropriately determined according to a type of the cable 1. In the example shown in FIG. 1, the cable 1 is a differential signaling cable having a twinaxial structure and is configured to include the two conductors 10.

The first electrical insulating member 11 may be provided over the conductors 10 with the other member not shown therebetween. In other words, the first electrical insulating member 11 is provided to directly or indirectly coat the conductors 10.

The material for the first electrical insulating member 11, if it is a material which is not dissolved by contact with a catalyst solution or a plating solution to be used in order to form the shield 12 made of the plating layer, is not particularly limited, but, typically, the material for the first electrical insulating member 11 is a polyethylene or a fluoropolymer resin. In particular, the polyethylene is preferable as the material for the first electrical insulating member 11 because it is easy in availability and high in performance of electron beam resistance. Specific examples of the fluoropolymer resin to be able to be used include a polytetrafluoroethylene (PTFE), a perfluoroalkoxy (PFA), a perfluoroethylene propene copolymer (FEP), an ethylene-tetrafluoroethylene copolymer (ETFE), a tetrafluoroethylene-perfluorodioxole copolymer (TFE/PDD), a polyvinylidene fluoride (PVDF), a polychlorotrifluoroethylene (PCTFE), an ethylene-chlorotrifluoroethylene copolymer (ECTFE), a polyvinyl fluoride (PVF), and the like.

Further, in order to reduce the dielectric constant and the dielectric loss tangent, a foamed electrical insulating resin may be used as the material for the first electrical insulating member 11. In this case, the first electrical insulating member 11 can be formed by using, for example, a method, which kneads a foaming agent into a resin, and controls the degree of formation of foam in that resin by using the temperature or pressure during molding, a method, which injects an inert gas such as nitrogen or the like into a resin at a molding pressure, and allows formation of foam in that resin during pressure release, or the like.

In a transverse cross section of the cable 1, it is preferable that an outer edge of the first electrical insulating member 11 is being formed in a circular shape, an elliptical shape, or a rounded corner rectangular shape (a rectangular shape with rounded corners). In this case, the plating layer is easy to form with a uniform thickness on the entire surface of the first electrical insulating member 11. Further, a roughening treatment and a hydrophilizing treatment, which will be described later, are easy to perform uniformly on the entire surface of the first electrical insulating member 11.

It is preferable that the surface of the first electrical insulating member 11 is subjected to a surface treatment for an enhancement in the strength of the adhesion to the shield 12. The surface treatment includes at least either one of a roughening treatment and a hydrophilizing treatment.

When the surface of the first electrical insulating member 11 is subjected to the roughening treatment, the first electrical insulating member 11 has irregularities on the surface thereof. This allows a catalyst, which is used in a plating treatment for forming the shield 12, to become resistant to desorption from the surface of the first electrical insulating member 11. In addition, an anchoring effect is produced by the shield 12 passing into the depressed portions of the irregularities on the surface of the first electrical insulating member 11. This results in an enhancement in the strength of the adhesion between the overlying shield 12 made of the plating layer and the underlying first electrical insulating member 11. Furthermore, since there is an increase in the surface area of the first electrical insulating member 11, there is an increase in the amounts of polar functional groups to be produced that contribute to an enhancement in surface wettability resulting from the hydrophilizing treatment, which will be described later.

As the roughening treatment for the surface of the first electrical insulating member 11, it is possible to use a blasting treatment, for example. Examples of the blasting treatment to be used include: a dry ice blasting using dry ice particles as a blasting medium; a sand blasting using particles of alumina, SiC or the like as the blasting medium; a wet blasting using a liquid mixture (slurry) of water and an abrasive material as the blasting medium; and the like.

In particular, the dry ice blasting is preferably used in the roughening treatment for the surface of the first electrical insulating member 11. Since the dry ice sublimes under ambient pressure and does not remain on the surface of the first electrical insulating member 11 after the roughening treatment, when the dry ice blasting is used as the roughening treatment for the surface of the first electrical insulating member 11, there is no need for a cleaning step after the roughening treatment.

When the blasting treatment is used as the roughening treatment for the surface of the first electrical insulating member 11, the surface roughness of the first electrical insulating member 11 can be controlled by adjusting the particle diameter of the blasting medium to be used in the blasting treatment, the blasting pressure (spraying pressure) to be used in the blasting treatment, the distance between the blasting nozzle of the blasting device and the first electrical insulating member 11, the hardness of the first electrical insulating member 11, or the like.

Alternatively, in a case where the surface roughness of the surface of the first electrical insulating member 11 can be controlled by adjusting the reaction rate between a chemical solution and the first electrical insulating member 11 with the concentration or temperature of the chemical solution, a wet etching treatment using the chemical solution such as a sodium naphthalene complex solution or a chromic acid solution may be used in the roughening treatment for the surface of the first electrical insulating member 11. It should be noted, however, that, when the first electrical insulating member 11 is made of the polyethylene or the fluoropolymer resin, the use of the wet etching treatment using the chromic acid solution is not practical because the wet etching treatment using the chromic acid solution is very time-consuming.

Alternatively, the surface of the first electrical insulating member 11 may be subjected to the roughening treatment by performing a short period pulsation during extrusion molding of the first electrical insulating member 11. Alternatively, the surface of the first electrical insulating member 11 may be subjected to the roughening treatment during extrusion molding of the first electrical insulating member 11 by providing projections and depressions for roughening the surface of the first electrical insulating member 11 on an inner wall of a die of an extruder.

Further, it is preferable that the first electrical insulating member 11 is being made high in the surface wettability by a hydrophilizing treatment. By performing the hydrophilizing treatment on the surface of the first electrical insulating member 11, it is possible to produce polar functional groups in the surface of the first electrical insulating member 11, thereby resulting in an enhancement in the surface wettability thereof. Here, the polar functional groups refer to the functional groups (hydrophilic groups) each having a polarity such as a carboxy group or a hydroxy group or the like. In general, the presence of the polar functional groups is directly related to the surface wettability (see, e.g., Akira Nakajima, "The Wettability of Solid Surfaces, from Superhydrophilicity to Superhydrophobicity" Kyoritsu Publishing Co., Ltd., 2014).

By the wettability of the surface of the first electrical insulating member 11 being enhanced, a catalyst solution or the plating solution to be used in the plating treatment for the surface of the first electrical insulating member 11 is easily brought into contact with the surface of the first electrical insulating member 11 over the entire circumference thereof. As a result, the strength of the adhesion between the overlying shield 12 made of the plating layer and the underlying first electrical insulating member 11 is enhanced, and the uniformity of the thickness of the shield 12 is also enhanced. By the strength of the adhesion between the overlying shield 12 and the underlying first electrical insulating member 11 being enhanced, it is possible to suppress the occurrence of a degradation in the transmission properties of the cable 1 due to the formation of an air gap between the overlying shield 12 and the underlying first electrical insulating member 11. Further, by the uniformity of the thickness of the shield 12 being enhanced, it is possible to suppress the occurrence of a degradation in the transmission properties of the cable 1, which is caused by a variation in the thickness of the shield 12. In addition, by performing both the roughening treatment and the hydrophilizing treatment on the surface of the first electrical insulating member 11, the plating solution, which is used in the plating treatment for forming the shield 12, is easy to pass into the depressed portions of the surface irregularities of the first electrical insulating member 11 formed by the roughening treatment, and is therefore easier to spread over the surface of the first electrical insulating member 11.

For the hydrophilizing treatment for the surface of the first electrical insulating member 11, it is possible to use, for instance, a corona discharge exposure, a plasma exposure in a gas with an atmospheric compositional gas or a rare gas mixed therein, an ultraviolet irradiation, an electron beam irradiation, a y-ray irradiation, an X-ray irradiation, an ion beam irradiation, an immersion in an ozone containing liquid, or the like.

For example, when the corona discharge exposure using a device of a type that corona discharge light is radiated from a discharge probe is used in the hydrophilizing treatment for the surface of the first electrical insulating member 11, the amounts of the polar functional groups to be produced in the surface of the first electrical insulating member 11 can be controlled by adjusting the voltage output, the exposure time, the distance between the surface of the first electrical insulating member 11 and the tip of the discharge probe, or the like.

The shield 12 is the plating layer, which is formed by performing a plating treatment on the surface of the first electrical insulating member 11. The shield 12 is made of a metal such as a copper or the like. The shield 12 is, e.g., 1 to 10 μm in thickness.

Since the shield 12 is the plating layer, an air gap formation is less likely to occur between the overlying shield 12 and the underlying first electrical insulating member 11 as compared to a conventionally generally used shield made of a metal tape wrapped around a periphery of an electrical insulating member, and so the shield 12 is able to suppress the occurrence of a degradation in the transmission properties of the cable 1 due to this air gap formation. In particular, when the cable 1 is a thin diameter cable such as a high speed transmission cable or the like, using the plating layer as the shield 12 has a profound effect because when the metal tape is used as the shield 12, the metal tape is difficult to wrap around the periphery of the first electrical insulating member 11 of the cable 1 and is more likely to cause the air gap formation between the overlying shield 12 and the underlying first electrical insulating member 11.

Further, since the shield 12 is the plating layer, the shield 12 is not required to be of such a thickness that a mechanical strength required for the wrapping, as in the case of the shield made of the metal tape, is produced, but the shield 12 may be of such a thickness as to be able to suppress noise in the cable 1. For example, when a noise reduction of 1/30 to 1/1000 required for shielding for a general electronic device is assumed (see, e.g., "Technical Description, Electromagnetic Shield", Okayama Industrial Technology Center, Technical Information, No. 457, p. 5), on the principle of the skin effect, even when the copper shield is thinned to 1 to 2 μm, a substantially desired shielding effect can be obtained in a band of several tens of GHz. This allows the thickness of the shield 12 made of the plating layer to be reduced to about 1/10 of the thickness of the shield made of the metal tape. Note that the plating treatment for the present embodiment to be described later makes it possible to form the shield 12 including a uniform thickness of several tens of nm to several tens of μm.

The surface of the shield 12 is subjected to a surface treatment to enhance the strength of the adhesion to the second electrical insulating member 13. The surface treatment for the shield 12 is the same as that performed on the surface of the first electrical insulating member 11 and includes at least either one of a roughening treatment and a hydrophilizing treatment. Note that this surface treatment for the shield 12 is not performed on the entire surface of the shield 12, but that, in at least one end portion of the cable 1, there is a part thereof subjected to no surface treatment for the shield 12, which will be described later.

When the surface of the shield 12 is subjected to the roughening treatment, the shield 12 has irregularities on the surface thereof. In addition, the anchor effect is produced by the second electrical insulating member 13 passing into the depressed portions of the irregularities on the surface of the shield 12. This results in an enhancement in the strength of the adhesion between the overlying second electrical insulating member 13 and the underlying shield 12. Furthermore, since there is an increase in the surface area of the shield 12, there is an increase in the amounts of polar functional groups to be produced that contribute to an enhancement in the surface wettability of the shield 12 resulting from the hydrophilizing treatment for the surface of the shield 12.

In order to make the strength of the adhesion between the overlying second electrical insulating member 13 and the underlying shield 12 high, the arithmetic average roughness Ra of the part of the surface of the shield 12 subjected to the surface treatment therefor is preferably not lower than 0.5 μm. Further, in order to suppress the occurrence of a degradation in the transmission properties of the cable 1, the arithmetic average roughness Ra of the part of the surface of the shield 12 subjected to the surface treatment therefor is preferably not higher than 10 μm. The arithmetic average roughness Ra of the surface of the shield 12 can be measured with a laser microscope or the like. Note that the arithmetic average roughness Ra of the surface of the shield 12 before being subjected to the surface treatment (the roughening treatment) is lower than the arithmetic average roughness Ra of the surface of the shield 12 after the surface treatment (after the roughening treatment), and is not lower than 0.1 μm and lower than 0.5 μm.

In the roughening treatment for the surface of the shield 12 described above, the same treatment as the roughening treatment for the surface of the first electrical insulating member 11 such as the blasting treatment or the like can be used.

When the blasting treatment is used in the roughening treatment for the surface of the shield 12, it is preferable to use a sand blasting using hard particles of alumina, SiC or the like as the blasting medium. This is because the shield 12 made of the metal is harder than the first electrical insulating member 11 or the like, and, for example, in a dry ice blasting using dry ice as the blasting medium, the surface of the shield 12 is difficult to efficiently roughen.

When the blasting treatment is used in the roughening treatment for the surface of the shield 12, the surface roughness of the shield 12 can be controlled by adjusting the particle diameter of the blasting medium to be used in the blasting treatment, the blasting pressure (spraying pressure) to be used in the blasting treatment, the distance between the blasting nozzle of the blasting device and the shield 12, or the like.

Alternatively, an etching treatment using a chemical solution that is able to corrode the metal constituting the shield 12 may be used in the roughening treatment for the surface of the shield 12. For example, when the shield 12 is made of a copper, the etching treatment using a nitric acid as the chemical solution can be used in the roughening treatment for the surface of the shield 12.

When the etching treatment is used for the roughening treatment for the surface of the shield 12, the surface roughness of the shield 12 can be controlled by adjusting the rate of the corrosion reaction with the concentration or the temperature of the chemical solution.

Further, it is preferable that the shield 12 is being made high in the surface wettability by the hydrophilizing treatment. By performing the hydrophilizing treatment on the surface of the shield 12, it is possible to produce polar functional groups in the surface of the shield 12, thereby resulting in an enhancement in the surface wettability thereof.

By the wettability of the surface of the shield 12 being enhanced, an electrical insulating coating material to be used in a coating step for forming the second electrical insulating member 13 is easily brought into contact with the surface of the shield 12 over the entire circumference thereof. As a result, the strength of the adhesion between the overlying second electrical insulating member 13 and the underlying shield 12 is enhanced. In addition, the uniformity of the thickness or quality of the second electrical insulating member 13 is made high. Further, by performing both the roughening treatment and the hydrophilizing treatment on the surface of the shield 12, the electrical insulating coating material, which is used in the coating step for forming the second electrical insulating member 13, is easy to pass into the depressed portions of the surface irregularities of the shield 12 formed by the roughening treatment, and is therefore easier to spread over the surface of the shield 12.

For the hydrophilizing treatment for the surface of the shield 12, it is possible to use the same treatment as the hydrophilizing treatment for the surface of the first electrical insulating member 11 such as the corona discharge exposure or the like.

For example, when the corona discharge exposure using a device of a type that corona discharge light is radiated from a discharge probe is used in the hydrophilizing treatment for the surface of the shield 12, the amounts of the polar functional groups to be produced in the surface of the shield 12 can be controlled by adjusting the voltage output, the exposure time, the distance between the surface of the shield 12 and the tip of the discharge probe, or the like.

The second electrical insulating member 13 is a member that acts as a protective member or the like in the cable 1 and can be formed by using a polyurethane based resin, an acrylic based resin, a polyester based resin, a polyimide resin, or the like. The second electrical insulating member 13 is, for example, from 1 to 20 μm in thickness.

The second electrical insulating member 13 is formed by coating the surface of the shield 12 with the electrical insulating coating material that is the material for the second electrical insulating member 13. The coating of this electrical insulating coating material is performed by spraying with a spray, coating with a brush or a roller, immersion coating (a method that immerses the cable 1 with no second electrical insulating member 13 being formed therein in the electrical insulating coating material), or the like.

Figure 2:
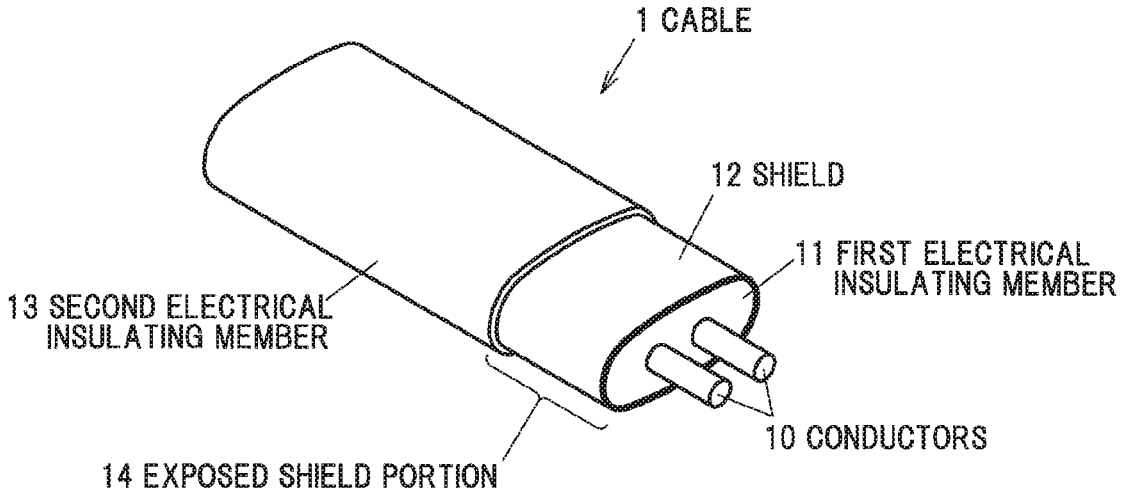
FIG. 2 is a perspective view showing the cable with a shield being exposed by removing a second electrical insulating member in an end portion of the cable to perform solder connection of a ground wire to the shield, or the like, during termination.

FIG. 2 is a perspective view showing the cable 1 with the shield 12 being exposed by removing the second electrical insulating member 13 in an end portion of the cable 1 to perform solder connection of a ground wire to the shield 12, or the like, during termination. Hereinafter, the part of the cable 1 with the shield 12 being exposed by removing the second electrical insulating member 13 is referred to as the exposed shield portion 14. The exposed shield portion 14 is provided in at least one end portion of the cable 1 and is typically provided at both ends of the cable 1.

As described above, although the surface of the shield 12 is subjected to the surface treatment to make the strength of the adhesion to the second electrical insulating member 13 high, the surface of the shield 12 in the exposed shield portion 14 is subjected to no surface treatment. This is intended for the facilitation of the removal of the second electrical insulating member 13 in the exposed shield portion 14.

In the cable 1, the strength of the adhesion between the underlying shield 12 and the overlying second electrical insulating member 13 in the exposed shield portion 14 is lower than the strength of the adhesion between the underlying shield 12 and the overlying second electrical insulating member 13 in the other part of the surface of the shield 12 (the part being not included in the exposed shield portion 14 of the surface of the shield 12).

Also, in forming the second electrical insulating member 13, the region of the surface of the shield 12 being subjected to no surface treatment may not successfully be coated with the electrical insulating coating material, and may not be formed with the second electrical insulating member 13 thereon. In this case, the shield 12 in the exposed shield portion 14 of the cable 1 is not coated with the second electrical insulating member 13.

(Cable Producing Method)

Hereinafter, one example of a method for producing the cable 1 according to the present embodiment will be described.

First, the periphery of the two conductors 10 is coated with the first electrical insulating member 11 by conventional extrusion molding or the like.

Next, the surface of the first electrical insulating member 11 is subjected to the surface treatment described above, followed by being subjected to the plating treatment to form the shield 12 made of the plating layer on the surface of the first electrical insulating member 11. The plating treatment includes, for example, an electroless plating treatment and an electrolytic plating treatment. Hereinafter, the member constituted by the conductors 10, the first electrical insulating member 11, and the shield 12 produced through the steps up to here is referred to as a linear shape member.

Next, the surface of the shield 12 is intermittently subjected to the surface treatment described above including at least either one of the roughening treatment and the hydrophilizing treatment along the longitudinal direction of the linear shape member. At this point of time, the part included in the exposed shield portion 14 of the surface of the shield 12 is subjected to no surface treatment.

For example, when the blasting treatment is used as the roughening treatment for the surface of the shield 12, the blasting medium is blasted only to the region being not included in the exposed shield portion 14 of the surface of the shield 12, or, with the region included in the exposed shield portion 14 of the surface of the shield 12 being allowed to remain masked, the blasting medium is blasted to the entire region of the surface of the shield 12. Alternatively, when the etching treatment is used as the roughening treatment for the surface of the shield 12, with the region included in the exposed shield portion 14 of the surface of the shield 12 being allowed to remain masked, the entire region of the surface of the shield 12 is immersed in the chemical solution.

Next, the surface of the shield 12 is formed with the second electrical insulating member 13 by coating thereon. At this point of time, when the part of the surface of the shield 12 being subjected to no surface treatment (the part included in the exposed shield portion 14 of the surface of the shield 12) is formed with the second electrical insulating member 13 thereon, the strength of the adhesion between the underlying shield 12 and the overlying second electrical insulating member 13 in the exposed shield portion 14 is lower than the strength of the adhesion between the underlying shield 12 and the overlying second electrical insulating member 13 in the other part of the surface of the shield 12 (the part being not included in the exposed shield portion 14 of the surface of the shield 12).

Further, when the part of the surface of the shield 12 being subjected to no surface treatment cannot be formed with the second electrical insulating member 13, the shield 12 in the exposed shield portion 14 of the cable 1 is not coated with the second electrical insulating member 13.

Hereinafter, the linear shape member formed with the second electrical insulating member 13 is referred to as the cable 2.

Next, the cable 2 is cut in the parts of the surface of the shield 12 being subjected to no surface treatment, i.e., in the exposed shield portions 14, resulting in the cables 1.

Figure 3:
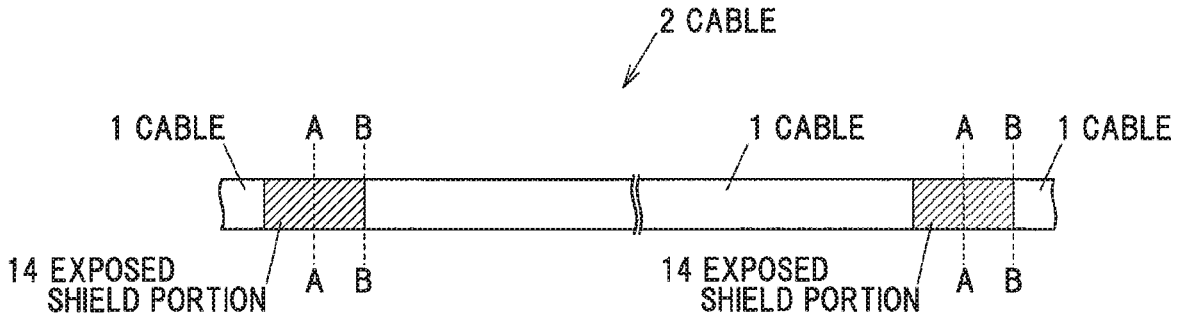
FIG. 3 is a conceptual diagram showing locations of exposed shield portions and cutting locations for the cable before cutting.

FIG. 3 is a conceptual diagram showing locations of the exposed shield portions 14 and cutting locations for the cable 2 to be cut into the cables 1. For example, the cable 2 is cut at the locations indicated by the dotted lines A-A in FIG. 3, i.e., cut at the intermediate locations of the exposed shield portions 14 in the length direction of the cable 2, resulting in the cables 1 each having the respective two exposed shield portions 14 at the respective two ends. Further, the cable 2 is cut at the locations indicated by the dotted lines B-B in FIG. 3, i.e., cut at the one-ends of the exposed shield portions 14 in the length direction of the cable 2, resulting in the cables 1 each having the respective one exposed shield portion 14 at the respective one end.

Advantageous Effects of the Embodiment

According to the above embodiment, it is possible to provide the cable structured to be high in the strength of the adhesion between the shield 12 and the second electrical insulating member 13 overlying the periphery of that shield 12, and easy to terminate, and it is possible to provide the method for producing the same cable.

Summary of the Embodiments

Next, the technical ideas grasped from the above-described embodiments will be described with the aid of the reference characters and the like in the embodiments. It should be noted, however, that each of the reference characters and the like in the following descriptions is not to be construed as limiting the constituent elements in the claims to the members and the like specifically shown in the embodiments.

[1] A cable (1), comprising: a linear shape conductor (10); a first electrical insulating member (11) coating a periphery of the conductor (10); a shield (12) comprising a plating layer coating a surface of the first electrical insulating member (11); a second electrical insulating member (13) coating a surface of the shield (12); and an exposed shield portion (14) provided in at least one end portion of the cable (1) with the second electrical insulating member (13) being removed therefrom and the shield (12) being exposed therein during termination, wherein an adhesion strength between the shield (12) and the second electrical insulating member (13) in the exposed shield portion (14) is lower than an adhesion strength between the shield (12) and the second electrical insulating member (13) in an other part of the surface of the shield (12).

[2] The cable (1) according to the above [1], wherein an arithmetic average roughness Ra of the surface of the shield (12) in the other part thereof is in a range of not lower than 0.5 μm and not higher than 10 μm.

[3] A method for producing a cable (1), comprising: preparing a linear shape member (2) comprising a linear shape conductor (10), a first electrical insulating member (11) coating the conductor (10), and a shield (12) comprising a plating layer coating a surface of the first electrical insulating member (11); intermittently subjecting a surface of the shield (12) to a surface treatment including at least either one of a roughening treatment and a hydrophilizing treatment along a longitudinal direction of the linear shape member (2); after the surface treatment, by coating, forming a second electrical insulating member (13) on the surface of the shield (12); and cutting the linear shape member (2) formed with the second electrical insulating member (13) thereon at a part of the surface of the shield (12) being subjected to no surface treatment, wherein the part of the surface of the shield (12) being subjected to no surface treatment is the part in which the surface of the shield (12) is exposed.

[4] The producing method of the cable (1) according to the above [3], wherein the roughening treatment is performed by a blasting treatment or an etching treatment using a chemical solution which is able to corrode the shield (12).

[5] The method of producing the cable (1) according to the above [3] or [4], wherein the coating is performed by spraying or applying an electrical insulating coating material which is a material for the second electrical insulating member (13).

[6] The method of producing the cable (1) according to the above [3], wherein, during termination, in the part of the surface of the shield (12) being subjected to no surface treatment, the second electrical insulating member (13) is removed therefrom.

[7] The method of producing the cable (1) according to the above [3], wherein, in forming the second electrical insulating member (13), the part of the surface of the shield (12) being subjected to no surface treatment is not formed with the second electrical insulating member (13).

Figure 4:
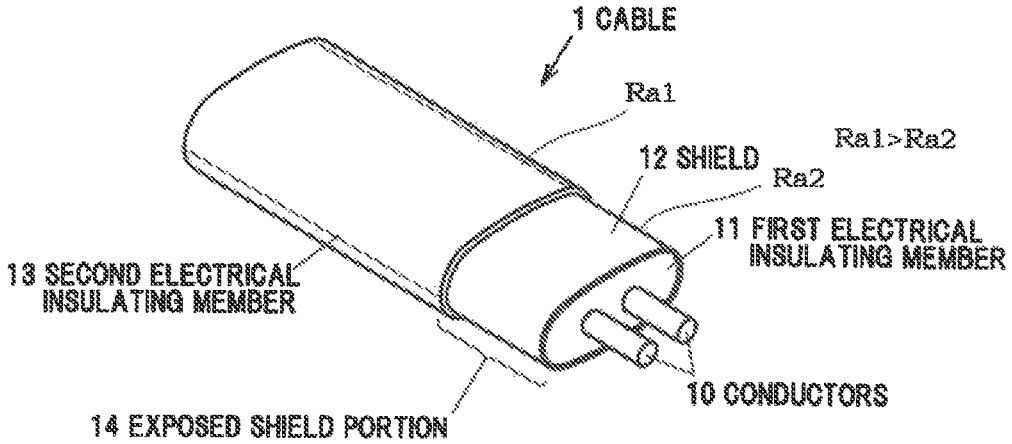
FIG. 4 is a perspective view showing the cable with a shield being exposed by removing a second electrical insulating member in an end portion of the cable to perform solder connection of a ground wire to the shield with the arithmetic average roughness comparison of areas of an outer surface of the shield.

[8] A cable (1), comprising:

a linear shape conductor (10);

a first electrical insulating member (11) coating a periphery of the conductor (10);

a shield (12) comprising a plating layer coating a surface of the first electrical insulating member (11);

a second electrical insulating member (13) coating a surface of the shield (12); and an exposed shield portion with the shield being not coated with the second electrical insulating member (13), wherein, as shown in FIG. 4, an arithmetic average roughness Ra2 of the surface of the shield (12) in the exposed shield portion is lower than an arithmetic average roughness Ra1 of the surface of the shield (12) in the other part thereof.

[9] The cable according to the above [8], wherein an arithmetic average roughness Ra of the surface of the shield in the exposed shield portion is not lower than 0.1 μm and lower than 0.5 μm, while an arithmetic average roughness Ra of the surface of the shield in the other part thereof is not lower than 0.5 μm and not higher than 10 μm.

Although the embodiments of the present invention have been described above, the present invention is not limited to the embodiments described above, but various modifications can be made without departing from the spirit of the invention.

Further, the embodiments described above are not to be construed as limiting the inventions according to the claims. In addition, it should be noted that not all the combinations of the features described in the embodiments are essential to the means for solving the problems of the invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A cable, comprising:

a linear shape conductor;

a first electrical insulating member coating a periphery of the conductor;

a shield comprising a plating layer coating a surface of the first electrical insulating member;

a second electrical insulating member coating a surface of the shield; and an exposed shield portion provided in at least one end portion of the cable with the second electrical insulating member being removed therefrom and the shield being exposed therein during termination, wherein an adhesion strength between the shield and the second electrical insulating member in the exposed shield portion is lower than an adhesion strength between the shield and the second electrical insulating member in an other part of the surface of the shield, wherein an arithmetic average roughness Ra of the surface of the shield in the other part thereof is in a range of not lower than 0.5 μm and not higher than 10 μm.

2. The cable according to claim 1, wherein the surface of the shield faces toward the second electrical insulating member.

3. The cable according to claim 1, wherein the second electrical insulating member abuts the surface of the shield.

4. The cable according to claim 1, wherein an arithmetic average roughness Ra of the surface of the shield in the exposed shield portion is different from an arithmetic average roughness Ra of the surface of the shield in the other part of the surface of the shield.

5. The cable according to claim 1, wherein an arithmetic average roughness Ra of the surface of the shield in the exposed shield portion is lower than an arithmetic average roughness Ra of the surface of the shield in the other part of the surface of the shield.

6. The cable according to claim 1, wherein the second electrical insulating member is disposed on the other part of the surface of the shield.

7. The cable according to claim 1, wherein the second electrical insulating member is disposed on an entirety of the other part of the surface of the shield.

8. A cable, comprising:

a linear shape conductor;

a first electrical insulating member coating a periphery of the conductor;

a shield comprising a plating layer coating a surface of the first electrical insulating member;

a second electrical insulating member coating an outer surface of the shield; and an exposed shield portion with the shield being not coated with the second electrical insulating member, wherein an arithmetic average roughness Ra of the outer surface of the shield in the exposed shield portion is lower than an arithmetic average roughness Ra of the outer surface of the shield in an other part thereof, and wherein the arithmetic average roughness Ra of the outer surface of the shield in the exposed shield portion is not lower than 0.1 μm and lower than 0.5 μm, while the arithmetic average roughness Ra of the outer surface of the shield in the other part is not lower than 0.5 μm and not higher than 10 μm.

9. The cable according to claim 8, wherein the outer surface of the shield faces toward the second electrical insulating member.

10. The cable according to claim 8, wherein the second electrical insulating member abuts the outer surface of the shield.

11. The cable according to claim 8, wherein an adhesion strength between the shield and the second electrical insulating member in the exposed shield portion is different from an adhesion strength between the shield and the second electrical insulating member in the other part of the outer surface of the shield.

12. The cable according to claim 8, wherein the second electrical insulating member is disposed on an entirety of the other part of the outer surface of the shield.

* * * * *